US007361069B2

(12) United States Patent
Mansfield et al.

(10) Patent No.: US 7,361,069 B2
(45) **Date of Patent: *Apr. 22, 2008**

(54) MULTIPLE SPEED MARINE PROPULSION SYSTEM

(75) Inventors: Aaron C. Mansfield, Lake Havasu City, AZ (US); Jason A. Mansfield, Lake Havasu City, AZ (US)

(73) Assignee: Max Machine Worx Inc., Lake Havasu City, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/516,387

(22) Filed: Sep. 6, 2006

(65) Prior Publication Data

US 2007/0004294 A1 Jan. 4, 2007

Related U.S. Application Data

(62) Division of application No. 10/825,772, filed on Apr. 15, 2004.

(60) Provisional application No. 60/463,887, filed on Apr. 17, 2003.

(51) Int. Cl.

| | |
|---|---|
| ***B63H 20/14*** | (2006.01) |
| ***B63H 20/00*** | (2006.01) |
| ***B63H 20/02*** | (2006.01) |
| ***B63H 23/02*** | (2006.01) |

(52) U.S. Cl. ..... 440/75; 440/112

(58) Field of Classification Search ..... 440/53, 440/57, 75, 83, 86, 111, 112

See application file for complete search history.

(56) References Cited

U.S. PATENT DOCUMENTS

| | | | | |
|---|---|---|---|---|
| 3,136,281 | A | 6/1964 | Kiekhaefer et al. | |
| 3,136,287 | A | 6/1964 | North | |
| 4,244,454 | A | 1/1981 | Bankstahl | |
| 4,257,507 | A | 3/1981 | Solomon | |
| 4,289,488 | A | 9/1981 | Weronke et al. | |
| 4,630,719 | A | 12/1986 | McCormick | |
| 4,634,691 | A | 1/1987 | Hedglin et al. | |
| 4,679,682 | A | 7/1987 | Gray, Jr. et al. | |
| 4,869,121 | A | 9/1989 | Meisenburg | |
| 4,897,057 | A | 1/1990 | McCormick | |
| 4,904,214 | A | 2/1990 | Eick | |
| 5,397,257 | A * | 3/1995 | Bergeron | 440/53 |

(Continued)

OTHER PUBLICATIONS

Trulio, Matt; Mercury Racing Goes Huge, Apr. 2006, p. 47-49.

(Continued)

*Primary Examiner*—Ajay Vasudeva
(74) *Attorney, Agent, or Firm*—Craig Miles; CR Miles, P.C.

(57) ABSTRACT

A marine stern drive and multi-speed transmission propulsion system in which a transmission, either manual or automatic, is interposed between the engine and stern drive extending at least partially outboard of the transom. A stern drive extension housing enclose the outboard transmission. The various embodiments may include automatic shifting, torque-absorbing couplings, dry oil sump and misalignment couplings. The system may be provided as an OEM item or as a retrofit and allows the engine to be maintained in its normal or original position thus enhancing the performance characteristics of the boat. The stern drive has forward, reverse and neutral shifting capabilities.

10 Claims, 6 Drawing Sheets

U.S. PATENT DOCUMENTS

| | | | | |
|---|---|---|---|---|
| 5,466,178 | A | 11/1995 | Inman, Sr. et al. | |
| 5,711,742 | A | 1/1998 | Leinonen et al. | |
| 5,829,564 | A | 11/1998 | Meisenburg et al. | |
| 6,200,177 | B1 | 3/2001 | Scott et al. | |
| 6,287,159 | B1 | 9/2001 | Polakowski et al. | |
| 6,350,165 | B1 | 2/2002 | Neisen | |
| 6,435,923 | B1 * | 8/2002 | Ferguson | 440/75 |
| 6,439,937 | B1 | 8/2002 | Mansson et al. | |
| 6,454,620 | B1 | 9/2002 | Theisen et al. | |
| 6,554,663 | B2 | 4/2003 | Neisen | |
| 2002/0072279 | A1 | 6/2002 | Neisen | |

OTHER PUBLICATIONS

Buyers Guide; Spring ed., Konrad Drives, 1 page www.konradmarine.com.

Advertizement; IMCO Xtreme Advantage 1000, 1 page www.imcomarine.com.

* cited by examiner

FIG.4
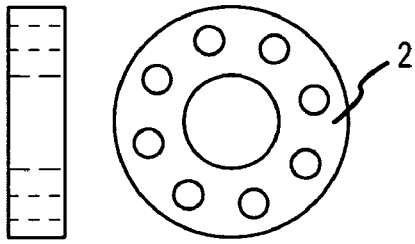
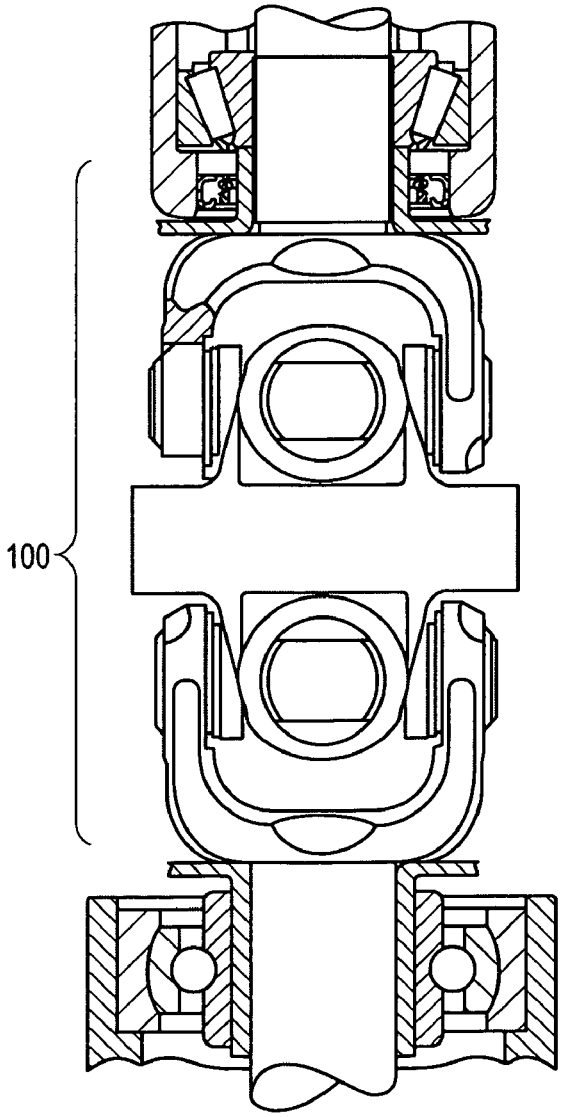
FIG.5
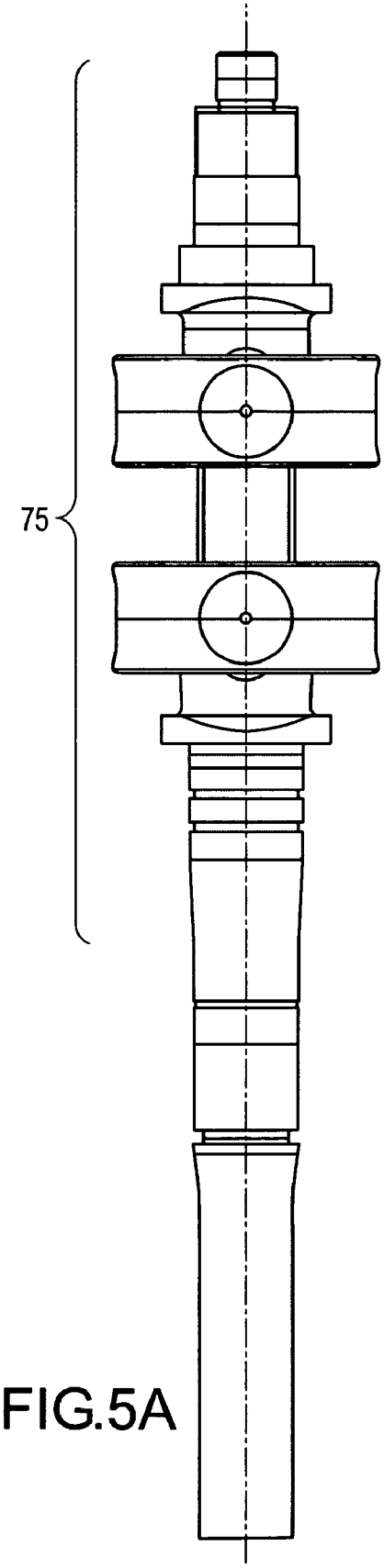
FIG.5A

FIG.6
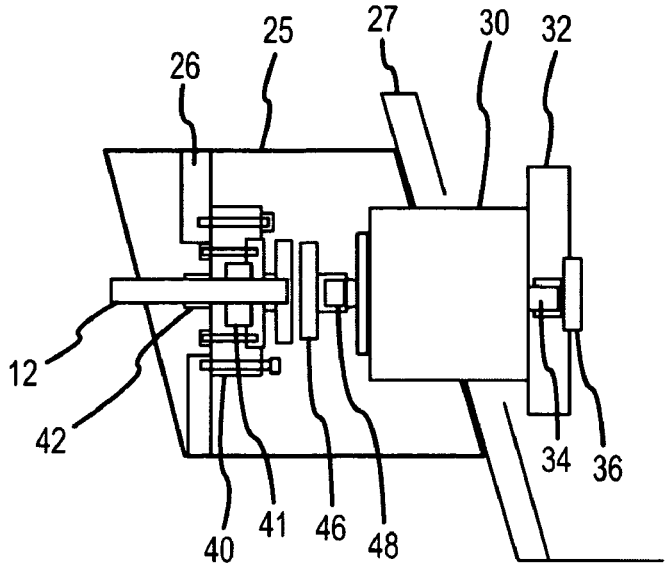
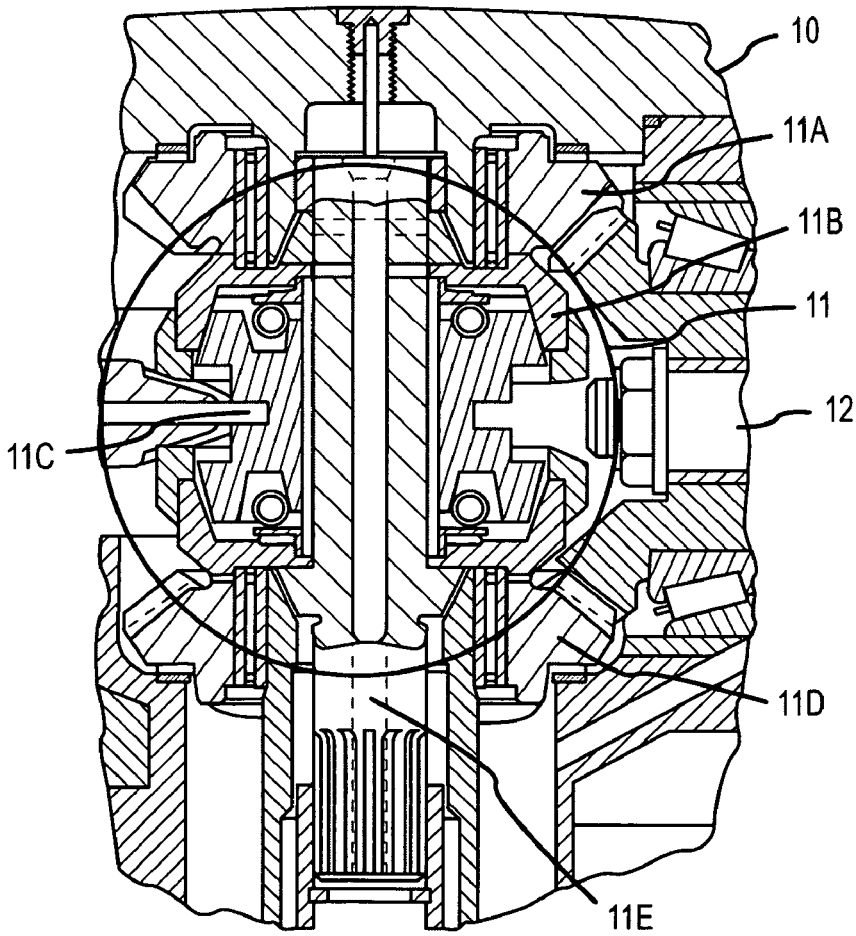
FIG.7

FIG.8
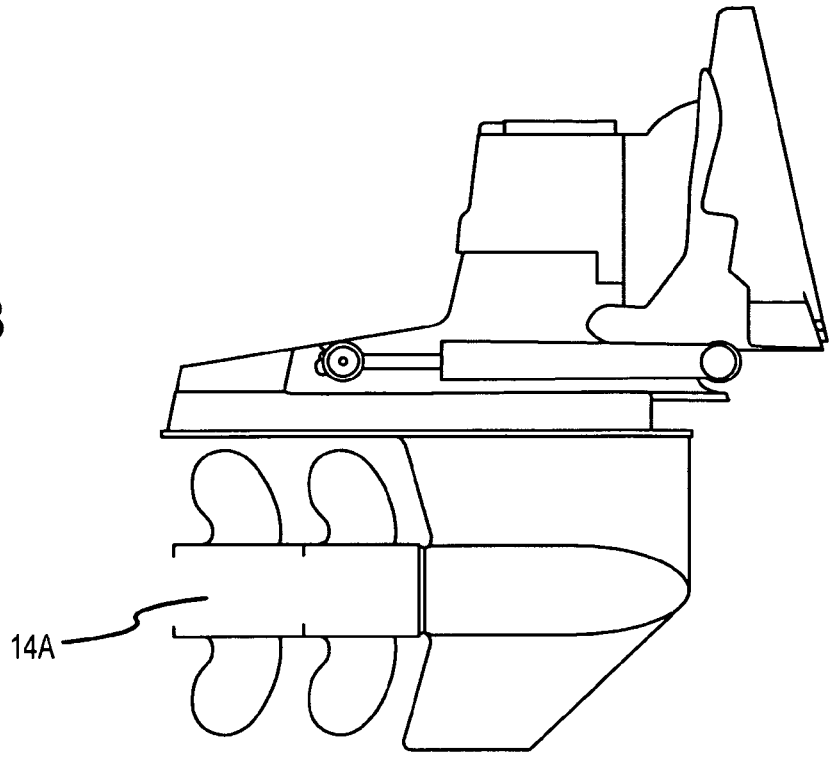
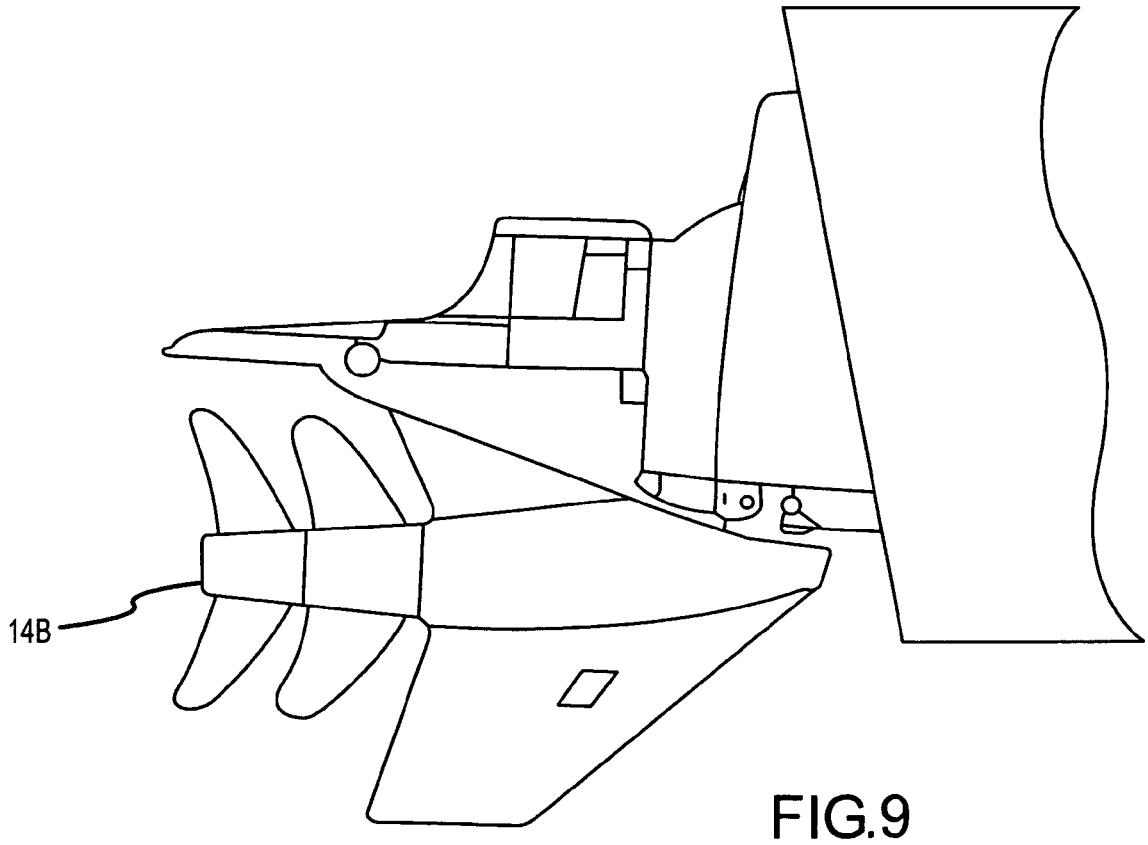
FIG.9

MULTIPLE SPEED MARINE PROPULSION SYSTEM

CROSS-REFERENCE TO RELATED APPLICATION

This United States Patent Application is a division of U.S. patent application Ser. No. 10/825,772, filed Apr. 15, 2004, and claims the benefit of U.S. Provisional Patent Application No. 60/463,887, filed Apr. 17, 2003, each hereby incorporated by reference.

This application is based on provisional patent application Ser. No. 60/463,887, filed Apr. 17, 2003, of the same title.

FIELD OF THE INVENTION

The present invention relates to marine stern drives propulsion systems and more particularly to a stern drive extension which will accommodate the addition of a transmission improving performance without the necessity of having to alter the original engine mounting position.

BACKGROUND OF THE INVENTION

The present invention was conceived during development a stern drive to improve boating performance by modifying marine propulsion system configurations. Further, the invention relates to the addition of a multi-speed shift mechanism which does not require changing the original engine mounting position in the boat.

Existing single speed marine stern drives have only a single gear ratio or speed with ratios typically between 1:1 to 2.25:1. A gear reduction normally occurs between the engine crankshaft and the stern drive propellor shaft. Conventional stern drive units may also have forward, neutral, and reverse gear direction shifting capabilities.

Although such drives are capable of shifting directions, the gear ratio remains fixed. The propellor blade is also in a fixed position. This, in turn, limits performance. For example, if the system is configured for maximum power and speed at low speed, the drive will have less power and speed at high speed. Likewise, if the system is configured for maximum power and speed at high speed, the drive system will lose power and speed at lower speeds. A significant benefit of the present propulsion system is that the marine engine can be mounted farther back in the boat, usually 2" to 12" from the transom, without having to locate the transmission between the engine and the stern drive in the boat, thus providing more space inside the boat as well as affording better weight distribution and boat handling characteristics.

With conventional multi-speed marine systems, the stern drive may have forward, neutral and reverse gear direction shifting capabilities, but the gear ratio is a single, fixed ratio. The propellor blade is also in a fixed position. The gear ratio or speed change are accomplished by a transmission located between the engine and the stern drive. With existing transmissions, low gear and high gear speed ratios are available. The benefits of the propulsion system of the present invention is that multiple gear ratios are available so at low speed acceleration is improved and at high speed greater maximum or top speed of the boat is available.

With gear reductions usually being limited to 1.33:1 in low gear and 1:1 in high gear, the drawbacks are increased weight. When a transmission is added to existing systems, the engine mounting position is moved forward in the boat, away from the transom, usually from 12" to 36". This repositioning, in turn, can drastically effect boat handling characteristics, cause boat planing problems and limit available interior space. Accordingly, it is generally difficult to retrofit a multi-speed system into a single-speed designed boat due to the engine mounting position problems.

BRIEF SUMMARY OF THE INVENTION

Briefly, the present invention is a multi-speed marine propulsion system in which the engine remains located in the boat in its normal position. A transmission, either manual or automatic, extends at least partially outboard of the transom and is coupled to a stern drive unit. A stern drive extension housing encloses the outboard transmission. A removable bearing carrier is provided in the extension housing. Various steering systems may be utilized as well as options such as a torque-absorbing coupling, a dry oil sump system and coupling arrangements to accommodate a rise or misalignment in the drive train components. A self-recharging air shift system also is also another optional feature.

BRIEF DESCRIPTION OF THE DRAWINGS

The above and other objects and advantages of the present invention will become more apparent from the following description, claims and drawings in which:

FIG. 4 is a detail view showing a type of torque-absorbing coupler that may be utilized with the propulsion system of FIG. 1;

FIG. 5 is a detail view showing a type of U-joint or constant velocity joint drive line option for the propulsion system of FIG. 1;

FIG. 5A is a variation of the joint shown in FIG. 10 used when the transmission output shaft and stern drive input are not in a straight line;

FIG. 6 is a side elevational view of the stern drive extension and transmission, transmission output shaft, transmission output coupler, stern drive, input coupler, transom, transmission and stern drive extension housing, bearing, bearing carrier and stern drive input shaft;

FIG. 7 is a detail view showing forward, neutral and reverse shifting capabilities of the stern drive in the said propulsion system of FIG. 1;

FIG. 8 is a side elevational view of the of the stern drive component of propulsion system of the present invention with dual counter-rotating propellers;

FIG. 9 is a view showing the surface-piercing stern drive option for marine propulsion system of FIG. 1;

DETAILED DESCRIPTION OF THE DRAWINGS

Figure 1:
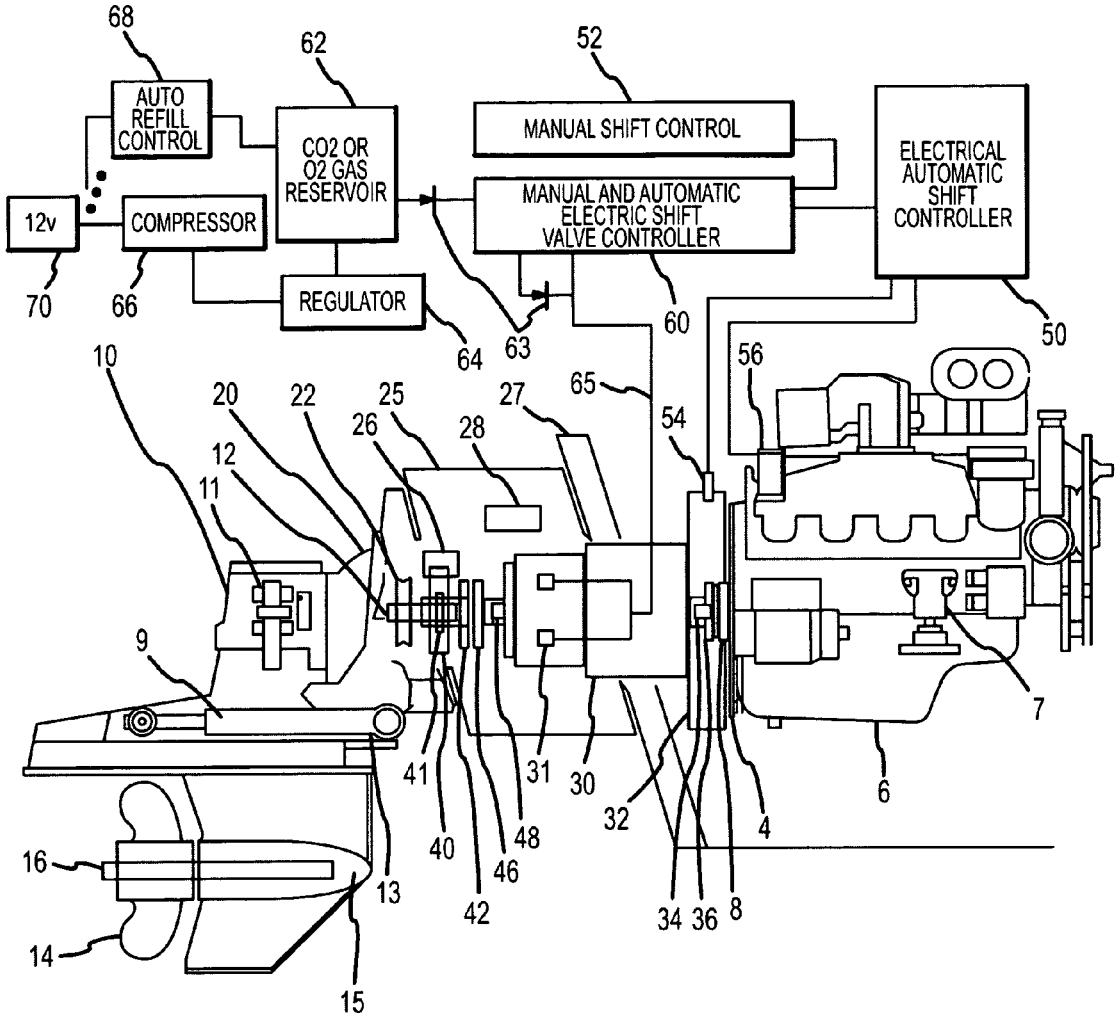
FIG. 1 is an overall schematic side elevational view of the propulsion system of the present invention and also showing the arrangement and configuration of the basic system which has been simplified omitting features such as the steering rams, the torque absorbing coupler, the hi-lift transmission and stern drive housing and the dry-sump oil cooling and recirculating system options.

The present invention is a multi-speed marine propulsion system and is shown in the drawings in which the same numerals are used throughout the various views to designate the same or similar elements. In FIG. 1, the system has an engine 6 with a crankshaft 8 and a manual and or automatic shifting mechanism 30 which may include a flywheel housing 32. An engine to transmission coupler 36, transmission coupler 46, a stern drive coupler 42 a bearing 41 and bearing carrier 40 are provided to connect the engine and stern drive in a torque transmitting relationship. The drive train includes a transmission and stern drive extension housing 25, a transom assembly and gimbal housing 20 and gimbal bearing 22.

The stern drive has an upper unit 10, a lower unit 15, input shaft 12, propellor shaft 16 with propellor 14 attached to shaft 16. Forward, neutral and reverse shifting capabilities are provided with external or integral steering capabilities and trim and tilt functions 13. A self-generating and self-recharging manual or automatic air shift system 60 is also shown. This configuration maintains the rear engine block mounting surface 4, engine crankshaft 8 and side engine mounts 7 in their original mounting positions maintaining the mounting position of engine 6 in the boat as would occur without the addition of multi-speed transmission 30.

The invention provides the marine propulsion system FIG. 1 with a multi-speed manual and or automatic transmission 30 that is mounted outboard or partially extending through the boat transom 27 into the transmission and stern drive extension housing 25. With the extension located outboard of the transom, the engine 6 may be maintained in the original engine mounting position not requiring it to be moved forward to accommodate the multi-speed transmission 30.

Figure 11:
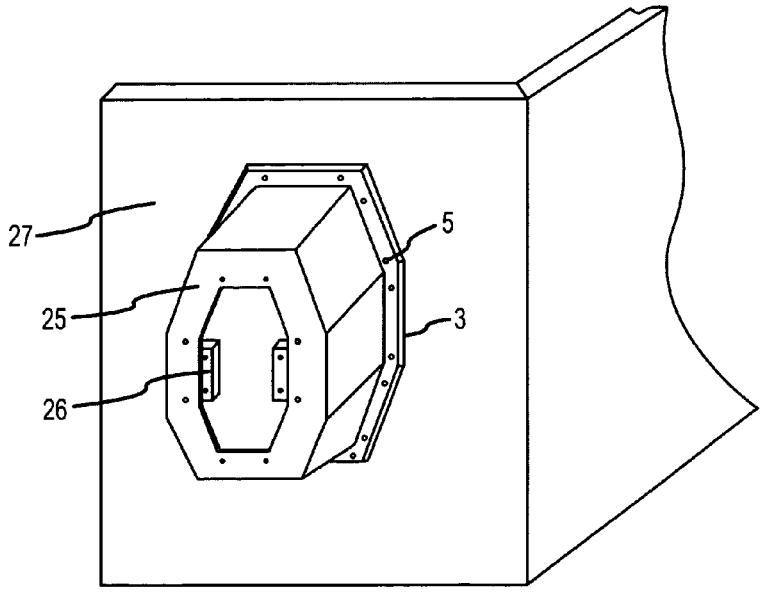
FIG. 11 is a perspective view showing the stern drive extension housing secured to the transom of a boat.

The transmission and stern drive extension housing 25 is mounted on the outside of the transom 27 of the boat by bolts or fasteners S secured to the housing with a gasket or seal 3 at the interface, as best seen in FIG. 11. The multi-speed transmission input shaft 34 is connected to the engine crankshaft 8 by the engine/transmission coupler 36. The multi-speed transmission output shaft 48 is connected to the input shaft of the stern drive 12 by the transmission coupler 46 and/or the stern drive coupler 42. All or some of these components are supported by a bearing 41 which is supported by a removable bearing carrier 40. The bearing carrier 40 is mounted inside the transmission and stern drive extension housing 25 at a support 26. The transom assembly 20 is mounted on the extension housing 25 and the stern drive 10 is mounted to the transom assembly and gimbal housing 20 with the stern drive input shaft 12 extending through and supported by the gimbal bearing 22 which connects with the stern drive coupler 42.

The preferred manual and or automatic multi-speed transmission 30 includes at least a low gear ratio or speed, as for example 1.55, 1.50, 1.44, 1.40, 1.35, 1.30, 1.26, 1.25, 1.21, 1.17, 1.16, 1.10, 1.08:1 and a high gear ratio or speed as for example 1:1. The transmission is preferably controlled by a system with automatic electric or electronic shift signal controllers 50, 52 that sense tachometer negative signals and/or a crankshaft trigger signal 54. These shift controllers 50, 52 control the manual and/or automatic electric shift valve control 60 which delivers a pneumatic signal through air lines 65 from the reservoir 62 through the one-way check valves 63 through air lines 65 and then finally through the one-way control valves 31 to shift the multi-speed transmission 30 from high gear ratio to low gear ratio and vice versa.

Also included is an automatic, self-pressurizing system consisting of a regulator and or regulators 64, electronic, electric and/or manual compressor control 68, air compressor and or compressors 66, also air lines 65 and check valves 63. This system maintains pressure to the shift bottle reservoir 62 insuring proper air pressure to the manual and/or automatic electric shift valve controller 60 in turn maintaining transmission shifting operations. The manual or automatic multi-speed transmission 30 may be of the disc, sprag, clutch, band, spring type and or any combination of these such as, but not limited to, those manufactured by Scott Owens racing or Lenco.

The stern drive 10 with forward, neutral and reverse shifting capabilities is shown in FIG. 7 in the configuration of the clutch 11, driven gear 11A, driven gear cup 11B, shift fork assembly 11C, driven gear 11D, clutch drive shaft 11E and input drive shaft 12 and may be, but not limited to, those stern drives available by Brunswick Corporation designated Bravo 1, 2, 3, X, XZ, XR, I.T.S., Sportmaster and Blackhawk. The lower unit 15 may be, but is not limited to, Brunswick Corporation's Alpha I, Alpha I Gen 2, Alpha SS. The stern drive 10 has an input shaft 12 that extends thru the transom and gimbal housing assembly 20 and the gimbal bearing 22 also through the extension housing bearing 41 with removable bearing carrier 40 attaching to the stern drive coupler 42.

The stern drive may have a single propellor 14, a dual counter-rotating propellor configuration 14A as shown in FIG. 8 or may be a surface-piercing configuration 14B as shown in FIG. 9.

The preferred transmission and stern drive extension housing 25 mounts directly to the outside of the transom 27 of the boat, as seen in FIG. 11. The gimbal housing assembly 20 mounts to the extension housing 25. The stern drive upper unit 10 mounts to the gimbal housing 20. With the addition of the transmission and stern drive extension housing 25, the transom 27 and gimbal housing assembly 20 and stern drive upper unit and lower unit 15 are set back from the transom 27 at a distance typically 3"-12". This, in turn, allows the engine 6 to be maintained in the original mounting position where located before the inclusion of the multi-speed transmission 30. This addition of the extension housing 25 also benefits the better hull lift, handling, planing, and turning characteristics, due to extension of the propellor shaft 16 and propellor 14 in relation to the distance from the transom 27 of the boat. The preferred transmission and stern drive extension housing 25 also has an interior mounting 26 for the removable bearing carrier 40 and bearing 41 and optional steering ram mounts. Trim and tilt function rams are mounted extending between the transom and gimbal assembly 20 and the stern drive 10.

Figure 2:
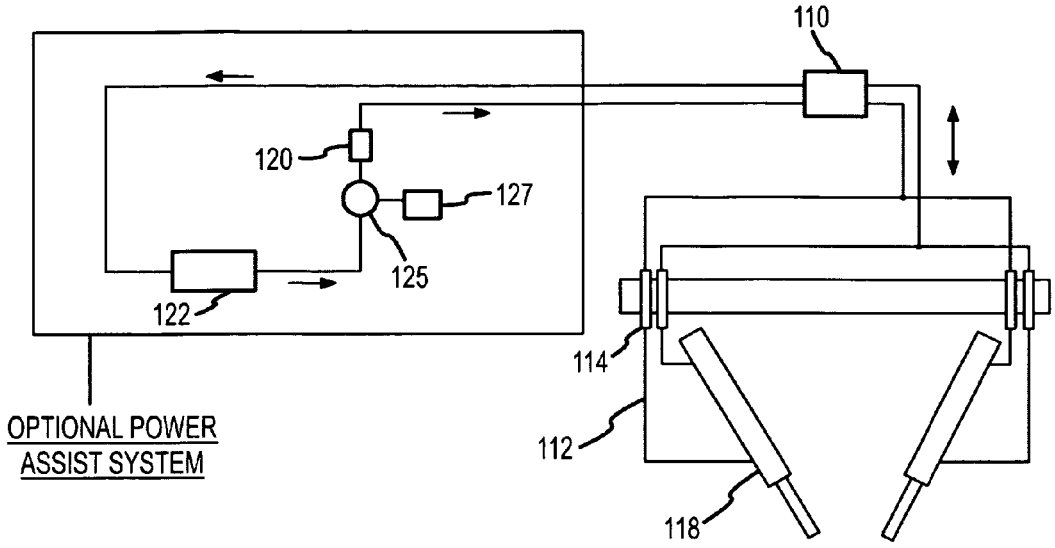
FIG. 2 is a schematic view of the propulsion system of the present invention shown in connection with a steering ram systems.

The steering systems in this system may be full power in conjunction with the OEM cable style with hydraulic controller valve or a self-contained hydraulic system with no power assist as shown in FIG. 2. This variation includes a helm 110, hydraulic lines 112, thru-hull fittings 114 and hydraulic steering ram or rams 118. Also shown are other parts of the system when using the full power style system which includes high pressure filter 120, a fluid cooler 122, a fluid pump 125 and a reservoir 127.

The steering function rams 9 can be mounted in various ways such as, but not limited to, mounting from the outside transom 27 of the boat to the stern drive upper unit 10 or from the outside mounts 28 on the sides of transmission and stern drive extension housing 25 to the stern drive upper unit 10. Another steering configuration may extend from the transmission and stern drive extension housing 25 to the trim ram 9 forward mounts. Trim hydraulic and steering hydraulic lines can be located internally in the extension housing 25 or routed externally through hull fittings to place them out of sight.

The propulsion system may also include other options such as but not limited to a torque-absorbing coupler 2 by Globe Rubber Works part # mrd 504pr as shown in FIG. 4. The torque absorbing coupler 2 is conventionally mounted between the engine crankshaft 8 and the engine/transmission coupler 36, and or between the transmission output coupler 46 and the stern drive input coupler 42.

Figure 3:
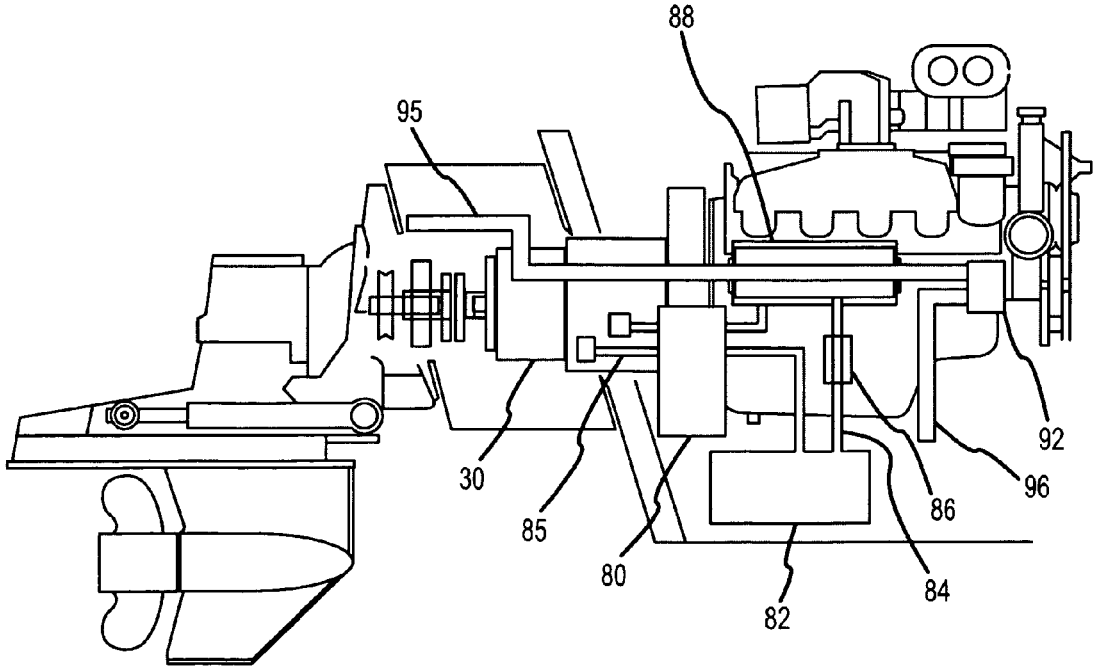
FIG. 3 is a schematic view of the of the propulsion system of the present invention as shown in FIG. 1 further including a dry sump-style oil cooling and recirculating system.

The invention also may incorporate various optional components such as a dry sump oil system as shown in FIG. 3 for the manual and or automatic transmission 30 including some or all of the following components a fluid pump 80 of any style, a fluid reservoir 82, fluid line or lines 84, 85, fluid filter 86, fluid cooler or coolers 88, and pressure valves and regulators. This system may incorporate the engine equipped water pump 92 for the cooler which receives fresh water at 95 and delivers it to the engine at 96.

Figure 10:
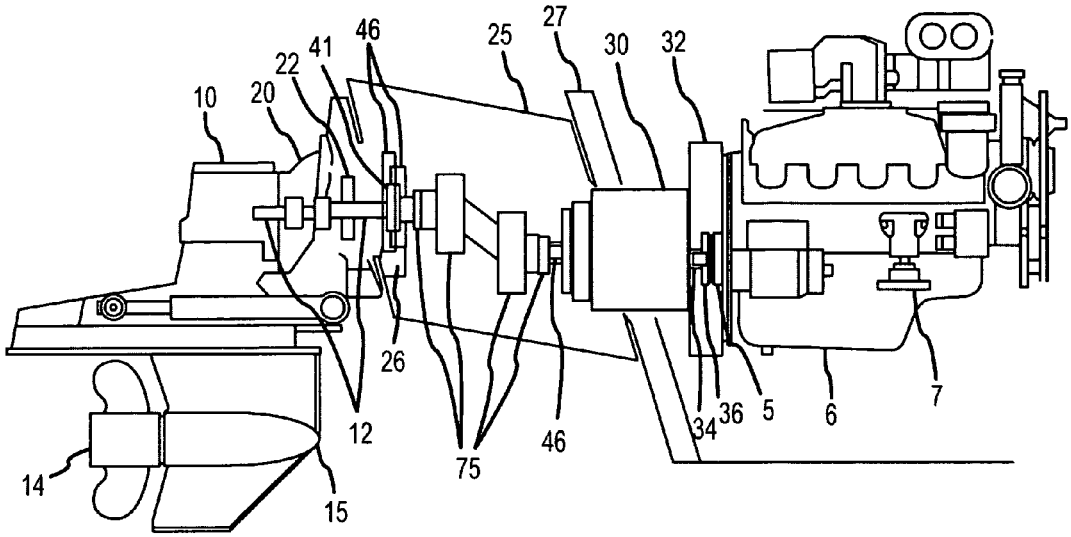
FIG. 10 is a schematic view of an alternate version of propulsion system of the present invention of a transmission including features to accommodate misalignment and angularity between the components.

Another option that may be applied to this system includes a transmission and stern drive extension housing 25 as shown in FIG. 10 with a ½" to 5" rise from the front mounting face that mounts at the transom 27 to the rear mounting face that the stern drive 10 mounts to, as shown in FIG. 10. This allows for optional x-dimension or stern drive height mounting dimension changes for better performing conditions on almost any type of boat.

With the preceding options, another option may also become necessary to accommodate a change in height of the stern drive 10 in the relationship between the stern drive input shaft 12, stern drive coupler 42, and the transmission coupler 46, transmission output shaft 48. As shown in FIG. 10, the relationship is no longer a straight line relationship. This problem is alleviated by a U-joint drive line 100 or a constant velocity joint drive line 75 as seen in FIGS. 5, 5A and 10. The drive line is mounted between the stern drive input coupler 42 and also the transmission output shaft 48 or the transmission output coupler 46 which allows for the proper angularity between the stern drive input shaft 12 and the transmission output shaft 48. This eliminates or reduces binding and vibration from occurring. It also may be necessary to move the bearing 41 and bearing carrier 40 inside the transmission and stern drive extension housing 25 to allow room for the drive line.

It will be obvious to those skilled in the at to make various changes, alterations and modifications to the invention described herein. To the extent such changes, alterations and modifications do not depart from the spirit and scope of the appended claims, they are intended to be encompassed therein.

We claim:

1. A method of fitting a stern drive to a boat, comprising the steps of:

(a) mounting an engine at a first location, said engine having an engine output shaft inboard of a transom of said boat;

(b) coupling a transmission to said engine output shaft of said engine;

(c) extending said transmission at least partly outboard through said transom of said boat;

(d) coupling said transmission to an input of a stern drive outboard of said transom; and sealably coupling an extension housing to said transom of said boat to supportingly enclose within said extension housing a part of said transmission coupled to said input of said stern drive.

2. The method of claim 1, wherein said transmission comprises a manual transmission shiftable between at least two gear ratios.

3. The method of claim 1, wherein said transmission comprises an automatic transmission shiftable between at least two gear ratios.

4. The method of any one of claims 2 or 3, wherein said manual transmission or said automatic transmission has a gear ratio shiftable over a range of about 1:1 to about 2:1.

5. The method of claim 3, further comprising the step of shifting said automatic transmission between said at least two gear ratios with an electronic shift controller.

6. The method of claim 5, further comprising the step of signaling said electronic shift controller to shift said automatic transmission between said at least two gear ratios.

7. The method of claim 6, further comprising the step of generating a signal receivable by said electronic shift controller based upon a speed of said engine.

8. The method of claim 1, wherein said step of coupling an extension housing to said transom of said boat to enclose within said extension housing a part of said transmission coupled to said input of said stern drive comprises the step of coupling a discrete extension housing to said transom of said boat to enclose within said extension housing a part of said transmission.

9. The method of claim 1, wherein said step of extending said transmission at least partly outboard of said transom of said boat avoids relocating said engine from said first location inboard of said transom of said boat to a second location inboard of said transom of said boat.

10. The method of claim 9, wherein said step of coupling a transmission to an engine output shaft of said engine comprises the steps of:

(a) uncoupling a first transmission from said motor output shaft of said engine; and (b) coupling a second transmission to said motor output shaft of said engine.

* * * * *